US005975806A

United States Patent [19]

Delamatyr

[11] Patent Number: 5,975,806

[45] **Date of Patent: *Nov. 2, 1999**

[54] ELEVATING UNIT FOR USE WITH JACK-UP RIG

[75] Inventor: George Delamatyr, Corpus Christi, Tex.

[73] Assignee: Searex, Inc., Mandeville, La.

[ * ] Notice: This patent is subject to a terminal disclaimer.

[21] Appl. No.: 09/139,519

[22] Filed: Aug. 25, 1998

Related U.S. Application Data

[63] Continuation of application No. 08/596,448, Feb. 2, 1996, Pat. No. 5,797,703.

[51] Int. Cl.[6] ..... E02B 17/08

[52] U.S. Cl. ..... 405/198; 405/196; 405/203; 114/265; 74/411.5

[58] Field of Search ..... 405/195.1, 196, 405/198, 203, 221, 224; 74/411.5, 422; 166/162, 202, 203; 188/177 R; 254/97; 114/264–266

[56] References Cited

U.S. PATENT DOCUMENTS 5,797,703 8/1998 Delamatyr ..... 405/198

*Primary Examiner*—David Bagnell
*Assistant Examiner*—Frederick L. Lagman
*Attorney, Agent, or Firm*—Garvey, Smith, Nehrbass & Doody, LLC

[57] ABSTRACT

An elevating unit for a jack-up rig provides a pinion gear that rotates upon a support frame for engaging a toothed rack of each leg of the jack-up rig. Each pinion gear is mounted on a gear shaft that extends in opposite directions from a plane of rotation of the gear. First and second roller bearings are mounted upon the frame for supporting the pinion gear at first and second pinion gear shaft end portions. On one shaft end portion, a planetary gear box engages the shaft, the gear box being motor driven. On the opposite side of the shaft end portion a brake hub is attached to the pinion gear shaft and carries a brake drum. A brake band extends about the drum, the band being operable to frictionally engage the brake drum to retard movement of the drum, hub and pinion gear shaft relative to the frame.

12 Claims, 4 Drawing Sheets

ELEVATING UNIT FOR USE WITH JACK-UP RIG

CROSS-REFERENCE TO RELATED APPLICATIONS

This is a continuation of U.S. patent application Ser. No. 08/596,448, filed Feb. 2, 1996, now U.S. Pat. No. 5,797,703, which is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to marine vessels and more particularly relates to marine vessels that have a plurality of legs that can be raised or lowered, the legs having lower ends that engage the sea bed and powered elevating units for raising the vessel hull or barge on the legs so that the hull can be lifted free of the waters surface. Even more particularly, the present invention relates to an improved elevating system for use with jack-up rigs wherein a rack and pinion type elevating unit has an improved braking arrangement that places a motor drive and its planetary gear box on one side of a drive shaft of a pinion gear, the other side of the drive shaft carrying a brake drum and its band or disk brake arrangement with roller bearing being positioned in between the pinion gear and the planetary gear box on one side and a second roller bearing between the pinion gear and the brake drum hub and band on the other side.

2. General Background of the Invention

In the offshore oil and gas well drilling and production industry, it is common to use jack-up barges or jack-up rigs for many purposes. These rigs can be used to repair or work over oil and gas wells. Very large jack-up rigs are fitted as oil and gas well drilling rigs for drilling for oil and gas in a marine environment.

It is known in the art to use an elevating system for raising a barge relative to the legs of a jack-up rig using a rack and pinion type gearing mechanism. In such a case, a plurality of pinion gears engage a toothed rack mounted on each leg of the jack-up rig. It is also known to mount such a rack on a truss-type leg that is typically triangular or square in horizontal cross section or cylindrical pipe.

When using such a rack and pinion type elevating mechanism, there is a need for a brake system for locking the elevating unit relative to the leg when the hull is to be fixed at a desired position relative to the underlying waters surface.

BRIEF SUMMARY OF THE INVENTION

The brake mechanism of the present invention is designed to hold all loads including storm loads independently of the gear mechanism that is used to power the pinion gear of an elevating unit.

The brake mechanism of the present invention permits the vessel to be held in place in the event of repairs to the gear mechanism or motor used to power the gear mechanism. The brake mechanism of the present invention permits fail safe holding in the event of a failure of the elevating systems. The present invention thus provides an improved jack-up rig and its elevating apparatus that includes a hull, a plurality of legs that are each movably mounted with respect to the hull so that each leg can be raised and lowered relative to the hull. Each of the legs provides a toothed rack to be engaged by a pinion gear of an elevating unit.

An elevating unit support frame is positioned in a case on the hull adjacent each leg. Each of the elevating units provides a gear for engaging the toothed rack of a leg so that rotation of the gear changes elevation of the respective leg relative to the hull. The gear is preferably a pinion gear that is a rotary gear member defining a plane of rotation.

The gear is mounted on a shaft that extends in opposite directions from the plane of the gear providing first and second gear shaft end portions.

A pair of roller bearings are mounted on the frame at the gear for supporting the gear at the first and second gear shaft end portions. A gear box is mounted on the frame for transferring rotary power to the first gear shaft end portion. The first roller bearing is positioned in between the gear and the gear box.

A motor drive is affixed to the gear box for powering the gear box. The motor drive is preferably a hydraulic motor that is bolted directly to the gear box.

A brake hub is rigidly attached to the second pinion gear shaft end portion for rotation therewith. The second roller bearing is positioned in between the pinion gear and the brake hub.

A brake member rigidly affixes to the brake hub for rotation therewith. The brake member extends radially and circumferentially about the brake hub. In the preferred embodiment, the brake member is a generally circular brake drum. The braking member can be a brake disk.

A brake operator engages the brake member for retarding movement of the brake hub, brake member and gear shaft relative to the frame.

The present invention thus provides an improved elevating unit for a jack-up rig having a hull and a plurality of legs wherein each of the legs has a toothed rack. The apparatus of the present invention provides advantages over prior art type elevating units. With the present invention, the brake mechanism permits independent controlled braking in the event of a system failure such as for example a failure of the motor drive or planetary gear box.

With the present invention, the brake mechanism permits the vessel to be held in place independently of the elevating mechanism so that repairs can be made of the gear mechanism or motor used to power the gear mechanism.

The present invention provides an improved braking mechanism that is designed to hold all loads including storm loads independently of the gear mechanism.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE INVENTION

Figure 1:
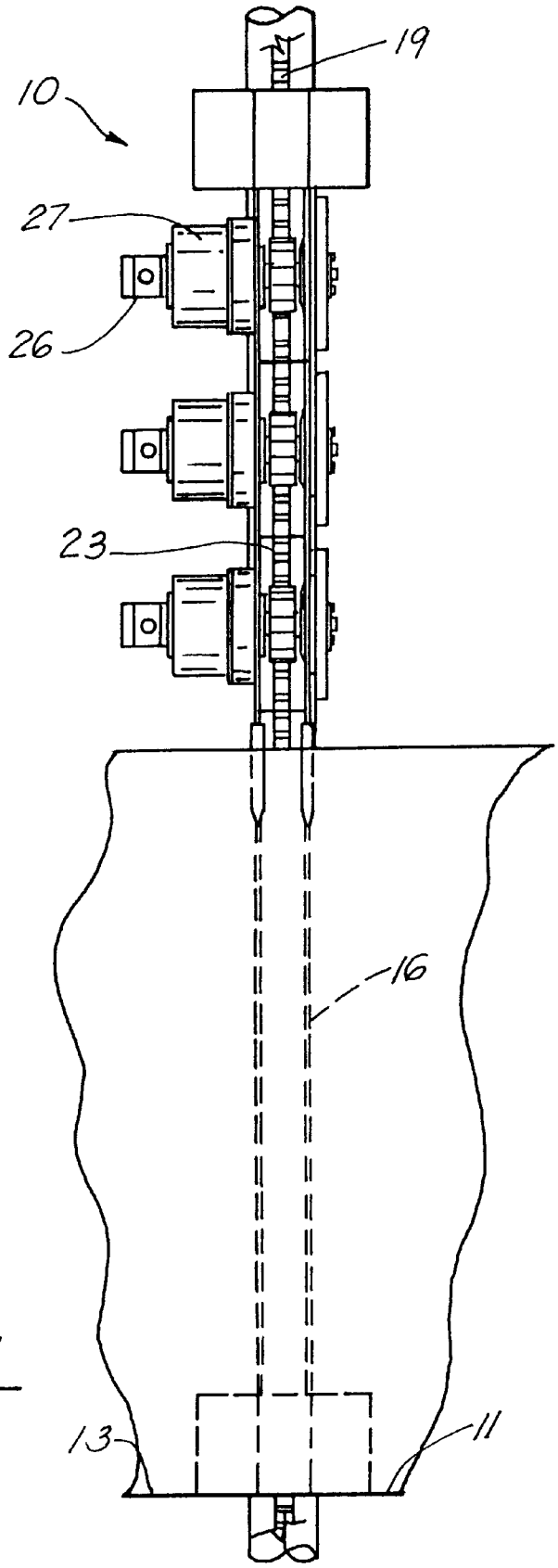
FIG. 1 is an elevational view of the preferred embodiment of the apparatus of the present invention.

FIGS. 1–4 show generally the preferred embodiment of the apparatus of the present invention designated generally as the numeral 10. Elevating unit 10 is used to elevate the leg 14 of a jack-up rig 11 with respect to the barge 12 of the jack-up rig. Jack-up rigs per se are well known in the art. Examples of jack-up rigs can be seen in the Rybicki U.S. Pat. No. 3,367,119, the Willke U.S. Pat. No. 3,606,251, the Barnard U.S. Pat. No. 3,750,210, the Wilson U.S. Pat. No. 3,945,450, the Lovie U.S. Pat. No. 3,967,457, the Shibuta U.S. Pat. No. 4,813,814, the Choate U.S. Pat. No. 5,139,366, each of which is incorporated herein by reference.

Figure 2:
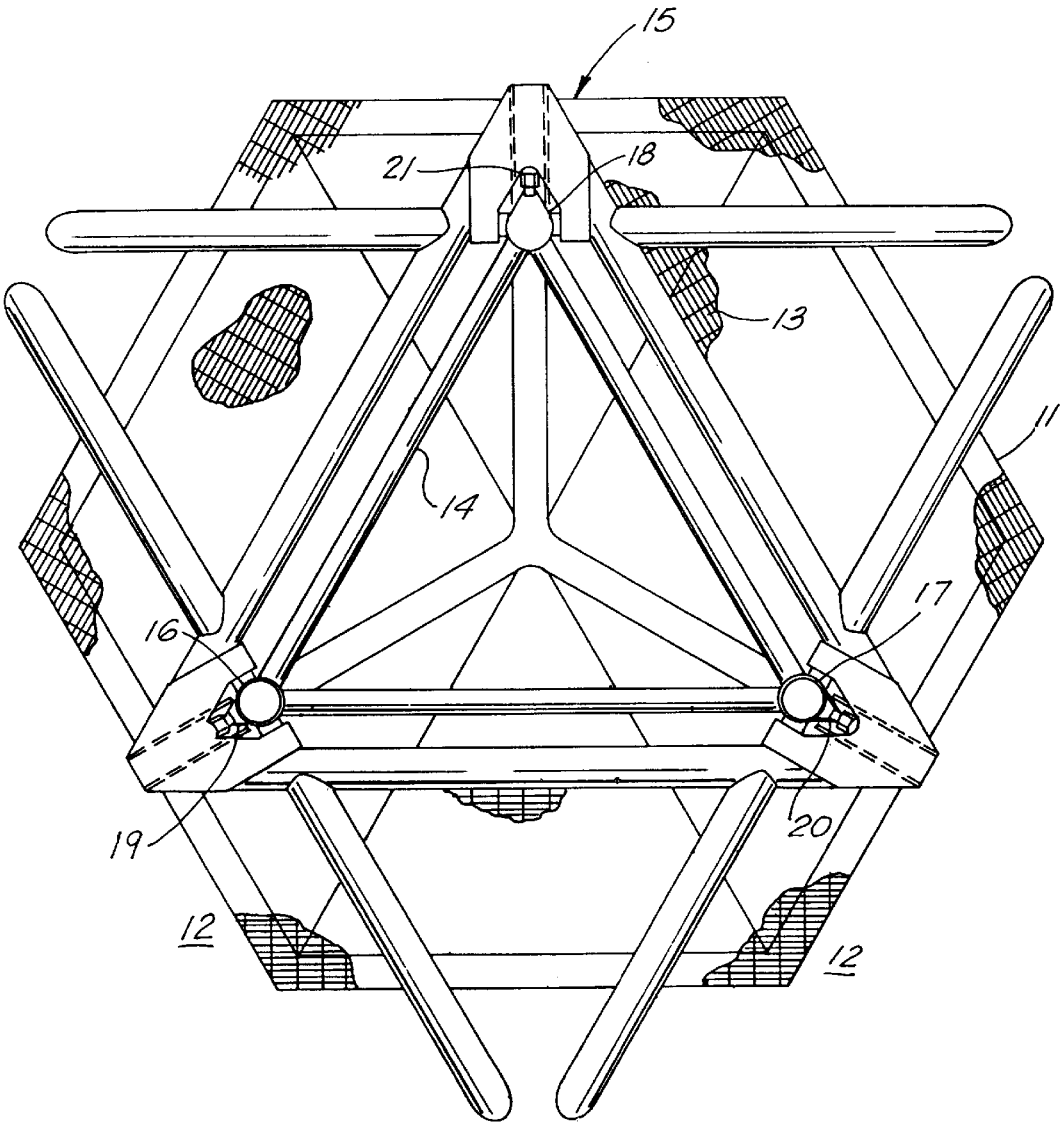
FIG. 2 is a top view of the preferred embodiment of the apparatus of the present invention.
Figure 3:
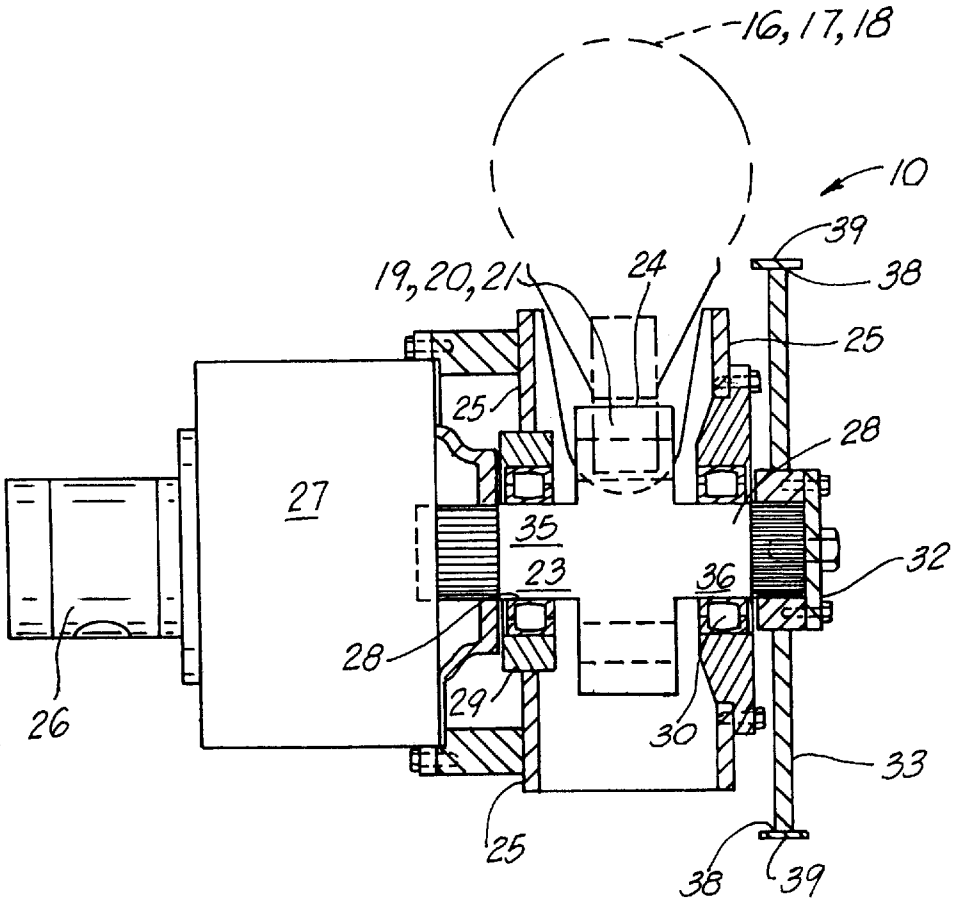
FIG. 3 is a sectional view taken along lines 3—3 of FIG. 1.
Figure 4:
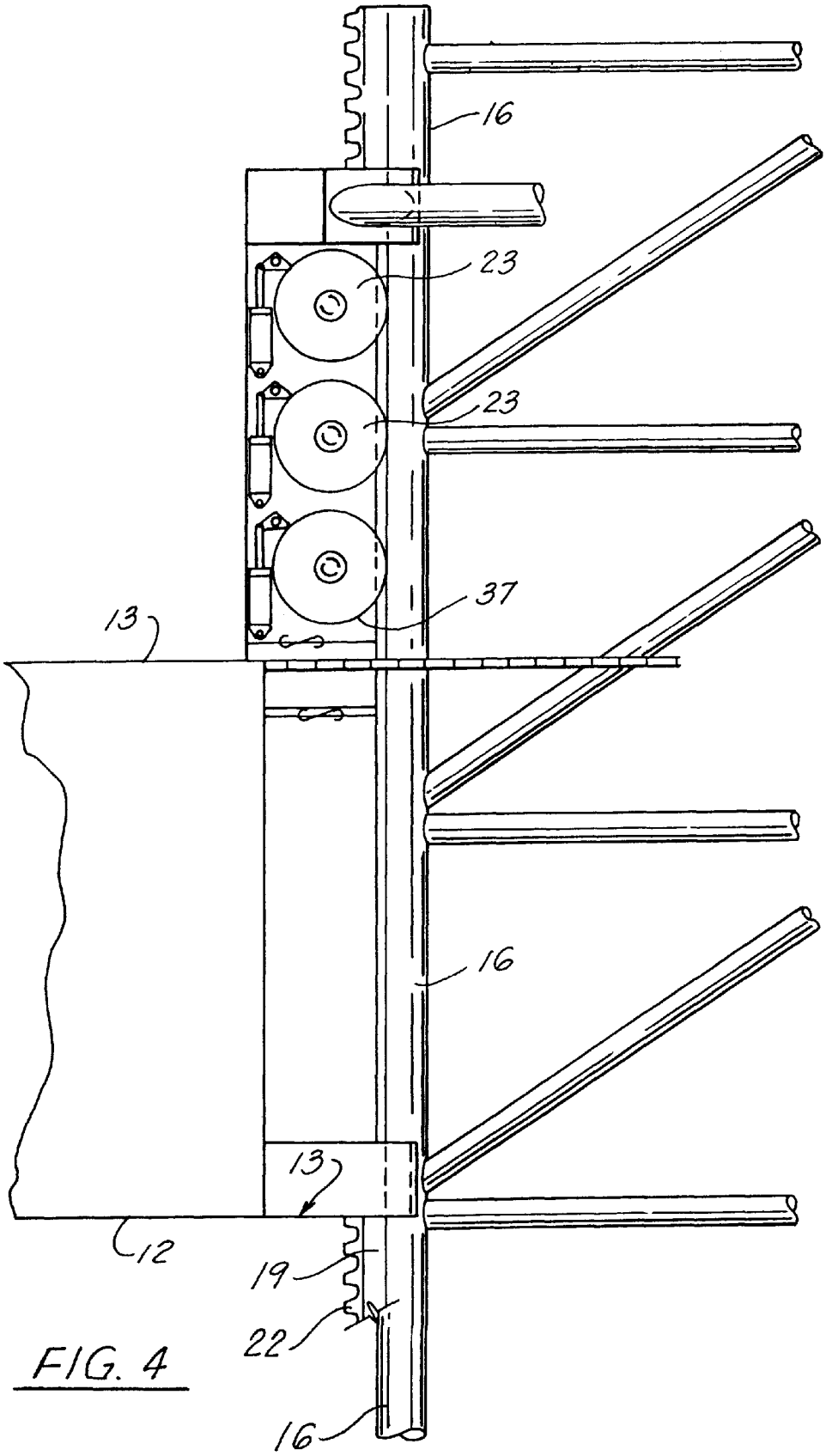
FIG. 4 is a partial elevational view of the preferred embodiment of the apparatus of the present invention.

A jack-up rig 11 includes a floating barge portion 12 that can be elevated upon a plurality of legs 14. The leg 14 can be in the form of a truss such as is shown in FIGS. 2, 3, and 4. Legs that are in the shape of a truss can also be seen in the Letourneau U.S. Pat. No. 3,183,676 incorporated herein by reference.

The barge 12 provides an upper deck area 13 that can be used to carry equipment such as oil and gas well drilling equipment or production equipment. The barge 12 and deck 13 provide an opening 15 through which leg 14 passes. Thus, the leg can move up or down relative to the barge by travelling through the opening 15. For a jack-up rig 11 having a truss-like leg, a plurality of chords 16–18 are provided as shown in FIG. 2.

In FIG. 3, each chord is shown as including a toothed rack 19–21 having teeth 22 that engage a pinion gear 23. A plurality of pinion gears 23 can be provided if desired as shown in FIGS. 1 and 4. Each pinion gear 23 is powered by a motor drive 26 and a planetary gearbox 27.

FIG. 3 shows the construction of the elevating unit 10 of the present invention in more detail. In FIG. 3, the pinion gear 23 is shown engaging the teeth 24 of a leg chord 16, 17, or 18. Each pinion gear 23, the attached motor drive 26 and gear box 27 are supported in a jack case 25 that is constructed of structural steel, being welded for example to barge 12. The jack case 25 thus supports the pinion gear 23, motor drive 26, and gear box 27 transferring the substantial load between each leg 16, 17, or 18 and the barge 12 of the jack-up rig 11.

Motor drive 26 can be attached directly to planetary gear box 27, for example by bolting. Pinion gear 23 is mounted upon pinion gear shaft 28. The shaft 28 has first and second shaft end portions 35 and 36. Each of the end portions 35, 36 can be splined for forming a connection with the planetary gear box 27 at gear shaft end portion 35, and with brake hub 32 at shaft end portion 36.

In the embodiment of FIG. 3, the gear shaft 23 is mounted for rotation to case 25 using a pair of roller bearings 29, 30. The roller bearing 29 forms an interface between shaft end portion 35 and case 25. The roller bearing 30 forms an interface between shaft end portion 36 and case 25.

Pinion gear 23 has a rotary portion that is generally circular in shape (FIG. 4) having a periphery 37. Teeth 24 extend about periphery 37 of pinion gear 23. The teeth 24 of pinion gear 23 correspond in shape and spacing to the teeth 22 of each rack 19–21. When the pinion gear 23 is powered to rotate using motor guide 26 and gear box 27, the pinion gear 23 also rotates, elevating or lowering a selected leg 16, 17, 18 relative to barge 12. This elevates the barge 12 above the water surface if desired, or lowers the barge to the water surface. The legs are typically raised when the jack-up barge 11 is to be transported.

An improved brake apparatus of the present invention is shown in FIG. 3. The brake apparatus includes brake hub 32 that is mounted to shaft end portion 36 using a splined connection as shown for example. A brake drum 33 is welded to hub 32 and rotates therewith. During use, the hub 32 and drum 33 rotate with pinion gear 23 and its shaft 28.

The brake drum 33 has a peripheral portion 37 that is engaged by brake band 39. In FIG. 3, the band 39 is shown encircling the periphery 38 of drum 33. When the drum band 39 is tightened against the periphery 38 of drum 33, rotation of shaft 28 and pinion gear 23 is stopped. From the above, it can be seen that a braking system is provided independently of motor drive 26, planetary gearbox 27, or pinion gear 23. This allows repairs to be made when the jack-up barge 11 is not elevating or lowering.

One of the features of the present invention is that the roller bearings 29, 30 are placed in between the pinion gear 23 and the gearbox 27 on one side and in between the pinion gear and brake drum 33 on the other side. Thus, the brake drum 33 and band are spaced from and opposite the gearbox 27.

The following table lists the parts numbers and parts descriptions as used herein and in the hereto.

PARTS LIST

| Part Number | Description |
|---|---|
| 10 | elevating unit |
| 11 | jack-up rig |
| 12 | barge |
| 13 | deck |
| 14 | leg |
| 15 | opening |
| 16 | chord |
| 17 | chord |
| 18 | chord |
| 19 | rack |
| 20 | rack |
| 21 | rack |
| 22 | teeth |
| 23 | pinion gear |
| 24 | teeth |
| 25 | jack case |
| 26 | motor drive |
| 27 | planetary gearbox |
| 28 | gear shaft |
| 29 | roller bearing |
| 30 | roller bearing |
| 31 | brake assembly |
| 32 | brake hub |
| 33 | brake drum |
| 34 | brake disk |
| 35 | end portion |
| 36 | end portion |
| 37 | periphery |
| 38 | periphery |
| 39 | band |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An elevating unit for a jack-up rig having a hull and a plurality of legs, each leg having a toothed rack, comprising:

a) an elevating unit support frame positioned on the hull adjacent to a leg;

b) a pinion gear mounted on the support frame and engaging the toothed rack so that rotation of the pinion gear changes the relative elevation between the leg and the hull, the pinion gear defining a plane;

c) the pinion gear being mounted on a pinion gear shaft that extends in opposite directions from the plane of the gear, providing first and second pinion gear shaft end portions;

d) first and second roller bearings mounted on the frame for supporting the pinion gear at the first and second pinion gear shaft end portions;

e) a planetary gearbox mounted on the frame for transferring rotary power to the first pinion gear shaft end portion, the first roller bearing being positioned in between the pinion gear and the planetary gear box;

f) a motor drive for powering the planetary gear box;

g) a brake hub attached to the second pinion gear shaft end portion, the second roller bearing being positioned in between the pinion gear and the brake hub;

h) a brake drum affixed to the brake hub, the drum extending radially and circumferentially about the brake hub; and i) a brake band extending circumferentially about the brake drum, the band being operable to frictionally engage the brake drum to retard movement of the drum, hub, and pinion gear shaft relative the frame.

2. The elevating unit of claim 1 wherein the motor drive is affixed directly to the gearbox.

3. The elevating unit of claim 1 wherein the frame includes a jack case having first and second spaced apart case portions.

4. The elevating unit of claim 3 wherein the first and second roller bearings are mounted respectively on the first and second case portions.

5. The elevating unit of claim 3 wherein the gearbox is mounted on one of the case portions.

6. The elevating unit of claim 1 wherein the brake drum is circular in shape, having a peripheral portion.

7. The elevating unit of claim 6 wherein the brake band engages the drum at the peripheral portion.

8. The elevating unit of claim 1 wherein the shaft includes a splined portion that engages the brake hub.

9. The elevating unit of claim 1 further comprising a barge, a plurality of legs mounted on the barge for up and down movement, each leg having a toothed rack thereon.

10. An elevating unit for a jack-up rig having a hull and a plurality of legs, each leg having a toothed rack, comprising:

a) an elevating unit support frame positioned on the hull adjacent to a leg;

b) a pinion gear mounted on the support frame and engaging the toothed rack so that rotation of the pinion gear changes the relative elevation between the leg and the hull, the pinion gear defining a plane;

c) the pinion gear being mounted on a pinion gear shaft that extends in opposite directions from the plane of the gear, providing first and second pinion gear shaft end portions;

d) first and second roller bearings mounted on the frame for supporting the pinion gear at the first and second pinion gear shaft end portions;

e) a planetary gearbox mounted on the frame for transferring rotary power to the first pinion gear shaft end portion, the first roller bearing being positioned in between the pinion gear and the planetary gear box;

f) a motor drive for powering the planetary gear box;

g) a brake hub rigidly attached to the second pinion gear shaft end portion for rotation therewith, the second roller bearing being positioned in between the pinion gear and the brake hub;

h) a braking member rigidly affixed to the brake hub for rotation therewith, the braking member extending radially and circumferentially about the brake hub; and i) a brake operator that engages the braking member, the operator being operable to frictionally engage the braking member to retard movement of the braking member hub, and pinion gear shaft relative the frame.

11. An elevating unit for a jack-up rig having a hull and a plurality of legs, each leg having a toothed rack, comprising:

a) an elevating unit support frame positioned on the hull adjacent to a leg;

b) gear means mounted on the support frame for engaging the toothed rack so that rotation of the gear means changes the relative elevation between the leg and the hull, the gear means including a rotary gear member defining a plane;

c) the gear being mounted on a gear shaft that extends in opposite directions from the plane of the gear, providing first and second gear shaft end portions;

d) first and second roller bearings mounted on the frame for supporting the gear at the first and second gear shaft end portions;

e) gearbox means mounted on the frame for transferring rotary power to the first gear shaft end portion, the first roller bearing being positioned in between the gear and the gearbox means;

f) a motor drive for powering the gearbox means;

g) a brake hub rigidly attached to the second pinion gear shaft end portion for rotation therewith, the second roller bearing being positioned in between the pinion gear and the brake hub;

h) a braking member rigidly affixed to the brake hub for rotation therewith, the braking member extending radially and circumferentially about the brake hub; and i) brake operator means that engages the braking member for frictionally engaging the braking member to retard movement of the brake hub, braking member and gear shaft relative the frame.

12. A jack-up rig, comprising:

a) a hull;

b) the hull having a plurality of legs, each movably mounted with respect to the hull, each leg having a toothed rack;

c) an elevating unit support frame positioned on the hull adjacent to a leg;

d) gear means mounted on the support frame for engaging the toothed rack so that rotation of the gear means changes the relative elevation between the leg and the hull, the gear means including a rotary gear member defining a plane;

e) the gear being mounted on a gear shaft that extends in opposite directions from the plane of the gear, providing first and second gear shaft end portions;

f) first and second roller bearings mounted on the frame for supporting the gear at the first and second gear shaft end portions;

g) gearbox means mounted on the frame for transferring rotary power to the first gear shaft end portion, the first roller bearing being positioned in between the gear and the gearbox means;

h) a motor drive for powering the gearbox means;

i) a brake hub rigidly attached to the second pinion gear shaft end portion for rotation therewith, the second roller bearing being positioned in between the pinion gear and the brake hub;

j) a braking member is rigidly affixed to the brake hub for rotation therewith, the braking member extending radially and circumferentially about the brake hub; and k) brake operator means for frictionally engaging the braking member to retard movement of the brake hub, braking member and gear shaft relative the frame.

* * * * *